US007889156B2

(12) United States Patent
Kwak et al.

(10) Patent No.: US 7,889,156 B2
(45) Date of Patent: Feb. 15, 2011

(54) PLASMA DISPLAY APPARATUS AND METHOD OF DRIVING THE SAME

(75) Inventors: Jongwoon Kwak, Seoul (KR); Seonghak Moon, Seoul (KR)

(73) Assignee: LG Electronics Inc., Seoul (KR)

( * ) Notice: Subject to any disclaimer, the term of this patent is extended or adjusted under 35 U.S.C. 154(b) by 732 days.

(21) Appl. No.: 11/956,166

(22) Filed: Dec. 13, 2007

(65) Prior Publication Data

US 2008/0211742 A1 Sep. 4, 2008

(30) Foreign Application Priority Data

Dec. 13, 2006 (KR) ..... 10-2006-0127015

(51) Int. Cl.
*G09G 3/28* (2006.01)

(52) U.S. Cl. ..... 345/68; 315/169.4; 313/582

(58) Field of Classification Search ..... 345/41, 345/42, 60, 63, 67, 68, 204, 214; 315/169.1, 315/169.4; 313/581, 582
See application file for complete search history.

(56) References Cited

U.S. PATENT DOCUMENTS 7,471,262 B2 * 12/2008 Kim et al. ..... 345/60

FOREIGN PATENT DOCUMENTS

KR 1020000074625 A 12/2000

* cited by examiner

*Primary Examiner*—Abbas Abdulselam
(74) *Attorney, Agent, or Firm*—Birch, Stewart, Kolasch & Birch, LLP

(57) ABSTRACT

There is provided a plasma display apparatus comprising a plasma display panel and a driver. The plasma display panel includes a first electrode and a second electrode. The driver alternately supplies a first sustain signal and a second sustain signal to the first electrode and the second electrode in a first subfield and supplies a third sustain signal and a fourth sustain signal that swing a positive polar voltage and a negative polar voltage in a second subfield to the first electrode and the second electrode.

20 Claims, 6 Drawing Sheets

PLASMA DISPLAY APPARATUS AND METHOD OF DRIVING THE SAME

This application claims the benefit of Korean Patent Application No. 10-2006-0127015 filed on Dec. 13, 2007, which is hereby incorporated by reference.

BACKGROUND OF THE DISCLOSURE

1. Field of the Disclosure

This document relates to a plasma display apparatus and a method of driving the same.

2. Description of the Related Art

A plasma display apparatus comprises a plasma display panel (PDP) for displaying an image and drivers for supplying driving voltages to the PDP.

The PDP comprises discharge cells partitioned off by barrier ribs. The discharge cells are filled with a main discharge gas such as neon (Ne), helium (He), or a gas mixture of Ne and He (Ne+He) and an inert gas comprising a small amount of xenon.

When a radio frequency voltage is applied to the discharge cells, vacuum ultraviolet (UV) rays are generated by discharge and the vacuum UV rays emit light from a phosphor applied between the barrier ribs.

The PDP comprises a plurality of electrodes and the drivers are connected to the PDP to supply the driving voltages to the electrodes. The drivers supply driving signals for displaying an image on the PDP to the electrodes when the PDP is driven.

On the other hand, since the discharge characteristic and the driving characteristic of the plasma display apparatus can vary in accordance with the driving signals supplied by the drivers, researches for optimizing the driving characteristic of the plasma display apparatus are continuously performed.

SUMMARY OF THE DISCLOSURE

A plasma display apparatus according to the present invention comprises a plasma display panel comprising a first electrode and a second electrode and a driver alternately supplying a first sustain signal and a second sustain signal to the first electrode and the second electrode in a first subfield and supplying a third sustain signal and a fourth sustain signal that swing a positive polar voltage and a negative polar voltage in a second subfield to the first electrode and the second electrode.

A method of driving a plasma display apparatus according to the present invention comprises alternately supplying a first sustain signal and a second sustain signal to the first electrode and the second electrode in a first subfield and supplying a third sustain signal and a fourth sustain signal that swing a positive polar voltage and a negative polar voltage to the first electrode and the second electrode in a second subfield.

BRIEF DESCRIPTION OF THE DRAWINGS

The implementation of this document will be described in detail with reference to the following drawings in which like numerals refer to like elements.

DETAILED DESCRIPTION OF EMBODIMENTS

Embodiments will be described in a more detailed manner with reference to the drawings.

Figure 1:
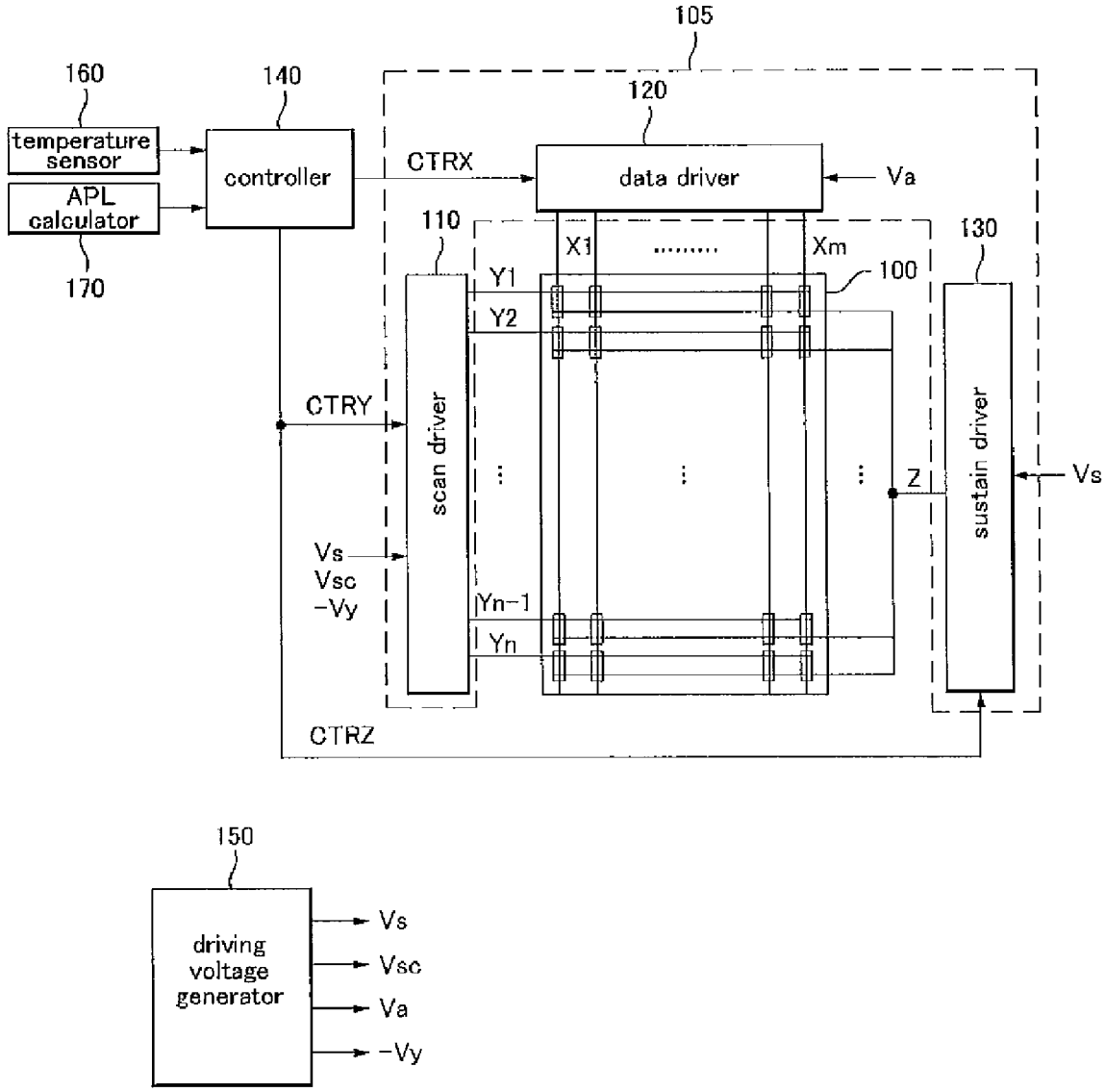
FIG. 1 illustrates a plasma display apparatus according to an embodiment of the present invention.

As illustrated in FIG. 1, a plasma display apparatus according to an embodiment of the present invention comprises a plasma display panel (PDP) 100, a driver 105, a controller 140, and a driving voltage generator 150. The driver 105 comprises a scan driver 110, a data driver 120, and a sustain driver 130.

Figure 2:
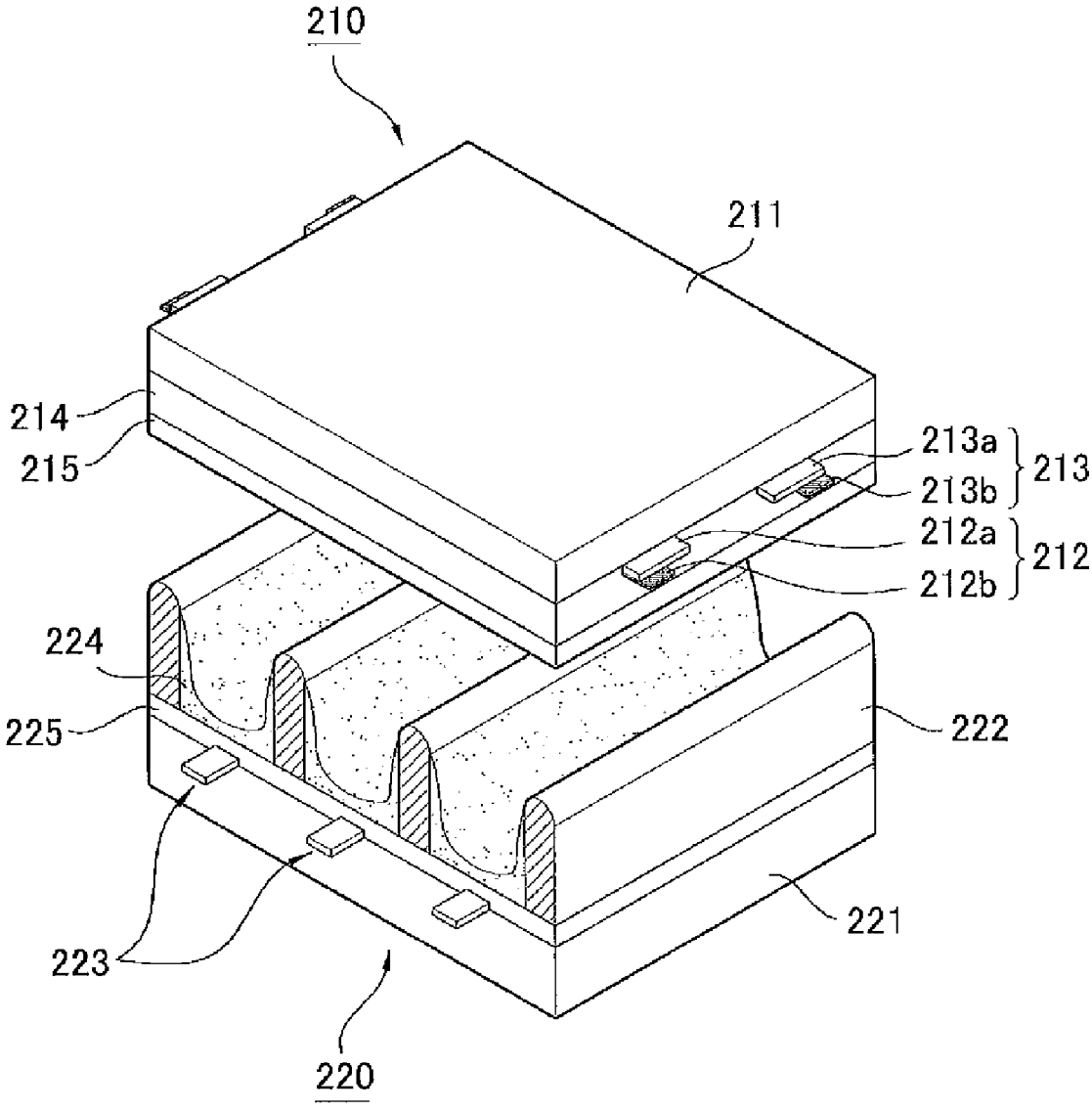
FIG. 2 illustrates the plasma display panel (PDP) of FIG. 1.

As illustrated in FIG. 2, the PDP 100 comprises a top surface panel 210 and a bottom surface panel 220. A scan electrode 212 and a sustain electrode 213 run parallel with each other on the top surface substrate 211 of the top surface panel. The scan electrode 212 and the sustain electrode 213 can comprise transparent electrodes 212*a* and 213*a* formed of transparent indium tin oxide (ITO) and bus electrodes 212*b* and 213*b* formed of a metal. In addition, the scan electrode 212 and the sustain electrode 213 can comprise only the bus electrodes 212*b* and 213*b*. An upper dielectric layer 214 covers the scan electrode 212 and the sustain electrode 213 to insulate the scan electrode 212 and the sustain electrode 213 from each other. A protective layer 215 is provided on the upper dielectric layer 214 and emits secondary electrons to facilitate discharge.

Data electrodes 223 are arranged on the bottom surface substrate 221 of the bottom surface panel 220 to intersect the scan electrode 212 and the sustain electrode 213. A lower dielectric layer 225 covers the data electrodes 223 to insulate the data electrodes 223 from each other. Barrier ribs 222 for partitioning off discharge cells are positioned on the lower dielectric layer 225. R, G, and B phosphors 224 are applied between the barrier ribs 222.

Figure 3:
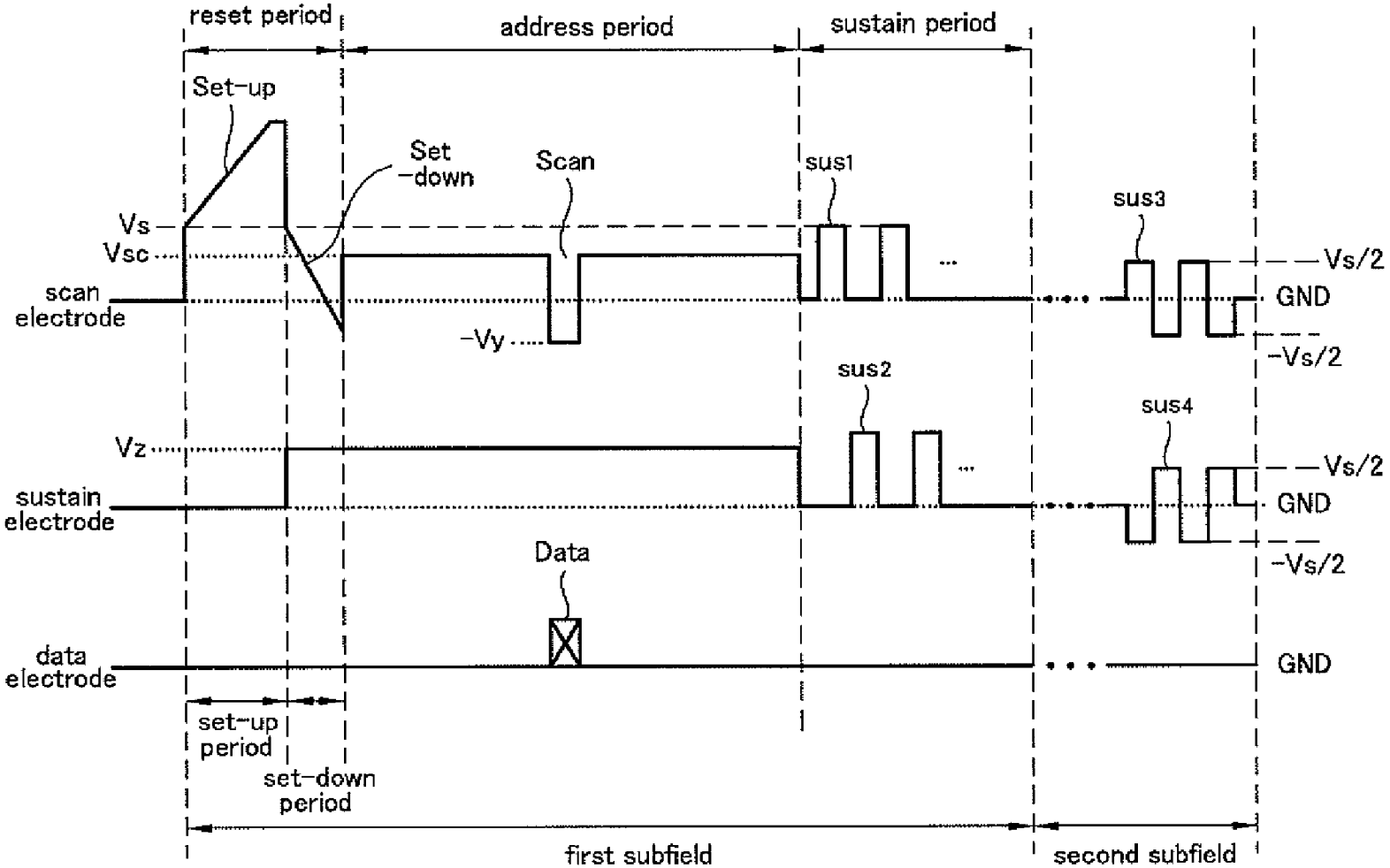
FIG. 3 illustrates the driving signals of the plasma display apparatus of FIG. 1.

As illustrated in FIG. 3, the scan driver 110 of the driver 105 supplies reset signals for initializing the wall charges of all of the discharge cells in a reset period to the scan electrodes under the control of the controller 140. The set up signal Set-up of the reset signals forms excessive wall charges in the discharge cells and supplies the set down signal Set-down of the reset signals to the scan electrodes Y1 to Yn.

The scan driver 110 sequentially supplies scan signals Scan that fall from a scan reference voltage Vsc to a scan voltage −Vy in an address period to the scan electrodes under the control of the controller 140. The data driver 120 supplies data signals Data to data electrodes in synchronization with the scan signals Scan. Therefore, discharge cells to emit light in a sustain period are selected.

The sustain driver 130 supplies a bias voltage Vz to sustain electrodes in the reset period and the address period to facilitate address discharge between the scan electrodes and the data electrodes. The bias voltage Vz can be actually equal to a sustain voltage Vs.

The driver 105 alternately supplies a first sustain signal sus1 and a second sustain signal sus2 to the scan electrodes and the sustain electrodes under the control of the controller 140 in the sustain period of a first sub field. That is, the scan driver 110 of the driver 105 supplies the first sustain signal sus1 to the scan electrodes and the sustain driver 130 of the driver 105 supplies the second sustain signal sus2 to the sustain electrodes. The highest voltage of the first sustain signal sus1 and the second sustain signal sus2 is the sustain voltage Vs.

In addition, the driver 105 supplies a third sustain signal sus3 and a fourth sustain signal sus4 that swing a positive polar voltage and a negative polar voltage in the sustain period of a second subfield to the scan electrodes and the sustain electrodes under the control of the controller 140. That is, the scan driver 110 of the driver 105 supplies the third sustain signal sus3 to the scan electrodes and the sustain driver 130 of the driver 105 supplies the fourth sustain signal sus4 to the sustain electrodes.

The first subfield and the second subfield can be continuously arranged and may not be continuously arranged. In addition, the first subfield and the second subfield can be comprised in one frame and can be comprised in different frames.

The highest voltage and the lowest voltage of the third sustain signals sus3 and the fourth sustain signal sus4 can be Vs/2 and −Vs/2. In addition, when the highest voltage of the third sustain signal sus3 is supplied, the lowest voltage of the fourth sustain signal sus4 can be supplied and, when the lowest voltage of the third sustain signal sus3 is supplied, the highest voltage of the fourth sustain signal sus4 can be supplied.

While the highest voltage of the first sustain signal sus1 or the second sustain signal sus2 is supplied, a voltage difference between the scan electrodes and the sustain electrodes can be actually equal to a voltage difference between the scan electrodes and the sustain electrodes while the highest voltage of the third sustain signal sus3 or the fourth sustain signal sus4 is supplied or a voltage difference between the scan electrodes and the sustain electrodes while the lowest voltage of the third sustain signal sus3 or the fourth sustain signal sus4 is supplied.

For example, when the highest voltage and the lowest voltage of the first sustain signal sus1 and the second sustain signal sus2 are the sustain voltage Vs and a ground voltage CND and the highest voltage and the lowest voltage of the third sustain signal sus3 and the fourth sustain signal sus4 are Vs/2 and −Vs/2 while the highest voltage Vs of the first sustain signal sus1 and the second sustain signal sus2 or the highest voltage Vs/2 of the third sustain signal sus3 and the fourth sustain signal sus4 is supplied, a voltage difference between the scan electrodes and the sustain electrodes is the sustain voltage Vs.

A difference between the highest voltage of the first sustain signal sus1 and the highest voltage of the third sustain signal sus3 can be no less than ⅕ of the highest voltage of the first sustain signal sus1 or the highest voltage of the third sustain signal sus3.

The controller 140 of FIG. 1 receives vertical and horizontal synchronizing signals and clock signals, generates timing control signals CTRX, CTRY, and CTRZ for controlling the operation timing and the synchronization of the drivers 120, 130, and 140 in the reset period, the address period, and the sustain period, and supplies the timing control signals CTRX, CTRY, and CTRZ to the corresponding drivers 120, 130, and 140 to control the drivers.

The data control signal CTRX comprises a sampling clock for sampling data, a latch control signal, a switch control signal for controlling the on and off times of a sustain driving circuit and a driving switch element. The scan control signal CTRY comprises a switch control signal for controlling the on and off times of a sustain driving circuit and a driving switch element in the scan driver 110. The sustain control signal CTRZ comprises a switch control signal for controlling the on and off times of a sustain driving circuit and a driving switch element in the sustain driver 130.

The driving voltage generator 150 generates a set up voltage Vsetup, the scan reference voltage Vsc, the scan voltage −Vy, the sustain voltage Vs, and a data voltage Va. The driving voltages can change in accordance with the composition of discharge gases or a discharge cell structure.

The driver 105 according to the present invention supplies different sustain signals in the first subfield and the second subfield in order to improve the driving characteristic of the PDP to correspond to the various driving conditions of the plasma display apparatus. For example, the driving conditions of the plasma display apparatus can comprise gray scale weight values of the first subfield and the second subfield, the temperature of the PDP, the average picture level (APL) of an image signal, the number of frames displayed on the PDP per a second, and the kind of a displayed image.

For example, when the gray scale weight value of the first subfield is smaller than the gray scale weight value of the second subfield, that is, when the number of light-emission times in one discharge cell where addressing discharge is generated in the sustain period of the first subfield due to sustain discharge is smaller than the number of light-emission times in one discharge cell where the addressing discharge is generated in the sustain period of the second subfield, the driver 105 supplies the first sustain signal and the second sustain signal to the scan electrodes and the sustain electrodes in the first subfield and supplies the third sustain signal and the fourth sustain signal to the scan electrodes and the sustain electrodes in the second subfield.

When the gray scale weight values increase, the number of sustain signals increases in the sustain period. Therefore, high voltage sustain signals are supplied, electromagnetic interference (EMI) is remarkably generated, opposed discharge increases between the scan electrodes and the data electrodes or the sustain electrodes and the data electrodes, and phosphors are damaged due to the opposed discharge so that latent image is generated. Therefore, according to an embodiment of the present invention, since low voltage sustain signals are supplied in a subfield where the gray scale weight values are large, the EMI, the opposed discharge, and the damage of the phosphors are remarkably reduced so that the latent image is reduced.

The temperature sensor 160 of FIG. 1 measures the temperatures of the PDP in the first subfield and the second subfield to output a temperature information signal to the controller 140. The controller 140 compares the temperatures of the PDP in the first subfield and the second subfield with a reference temperature. At this time, the first subfield and the second subfield are comprised in different frames.

When the temperature of the PDP in the first subfield is higher than the reference temperature and the temperature of the PDP in the second subfield is lower than the reference temperature, the scan driver 110 and the sustain driver 130 of the driver 105 reduces the number of sustain signals supplied in the first subfield and increases the number of sustain signals supplied in the second subfield in accordance with the control of the controller 140.

That is, when the temperature of the PDP is higher than the temperature of the PDP in the second subfield in the first sustain period, the driver 105 can supply the first and second sustain signals sus1 and sus2 in the first subfield period and can supply the third and fourth sustain signals sus3 and sus4 in the second subfield.

When the number of sustain signals increases in the second subfield where the temperature of the PDP is low, when the high voltage first and second sustain signals sus1 and sus2 are supplied, the EMI, the opposed discharge, the damage of the phosphors, and the latent image are reduced.

Therefore, according to an embodiment of the present invention, in the second subfield where the temperature of the PDP is low, the driver 105 supplies the third and fourth sustain signals sus3 and sus4 that swing the highest voltage and that lowest voltage of small magnitude to the scan electrodes and the sustain electrodes. Therefore, the EMI, the opposed discharge, and the damage of the phosphors are remarkably reduced so that the latent image is reduced.

The APL calculator 170 of FIG. 1 outputs the APLs of a first frame and a second frame to the controller 140. The controller 140 reduces the number of sustain signals when the APL increases and increases the number of sustain signals when the APL is reduced. When the APL of the first frame is higher than the APL of the second frame, the driver 105 can supply the first sustain signal and the second sustain signal in the first subfield comprised in the first frame and can supply the third sustain signal and the fourth sustain signal in the second subfield comprised in the second frame. Therefore, the low voltage sustain signals are supplied in the second frame where the APL is small and the number of sustain signals increases so that the EMI, the opposed discharge, the damage of the phosphors, and the latent image are reduced.

In addition, when m frames are displayed on the PDP per a second, the driver 105 can supply the first sustain signal and the second sustain signal and, when n (n>m) frames are displayed on the PDP per a second, the driver 105 can supply the third sustain signal and the fourth sustain signal. For example, when the PUP is driven by 50 Hz, the driver 105 supplies the high voltage first sustain signal and second sustain signals and, when the PDP is driven by 60 Hz, the driver 105 can supply the low voltage third sustain signal and fourth sustain signal. When the high voltage sustain signals are supplied while the number of frames displayed per a second increases, since the EMI, the opposed discharges the damage of the phosphors, and the latent image increase, according to an embodiment of the present invention, the low voltage third sustain signal and fourth sustain signal are supplied.

The controller 140 determines whether an image signal input from the outside is a moving image or a still image to control the driver 105. The controller 140 can determine that the input signal is the moving image when a change in gray scale values is larger than a reference value. The driver 105 can supply the first sustain signal and the second sustain signal when the moving image is displayed on the PDP and can supply the second sustain signal when the still image is displayed on the PDP. When the high voltage first sustain signal and second sustain signal are supplied while the still image is displayed, since the phosphors of a specific discharge cell are damaged for a long time, the latent image can be remarkably generated. Therefore, when the low voltage third sustain signal and fourth sustain signal are supplied while the still image is displayed according to an embodiment of the present invention, the damage of the phosphors and the latent image are reduced.

Figure 4A:
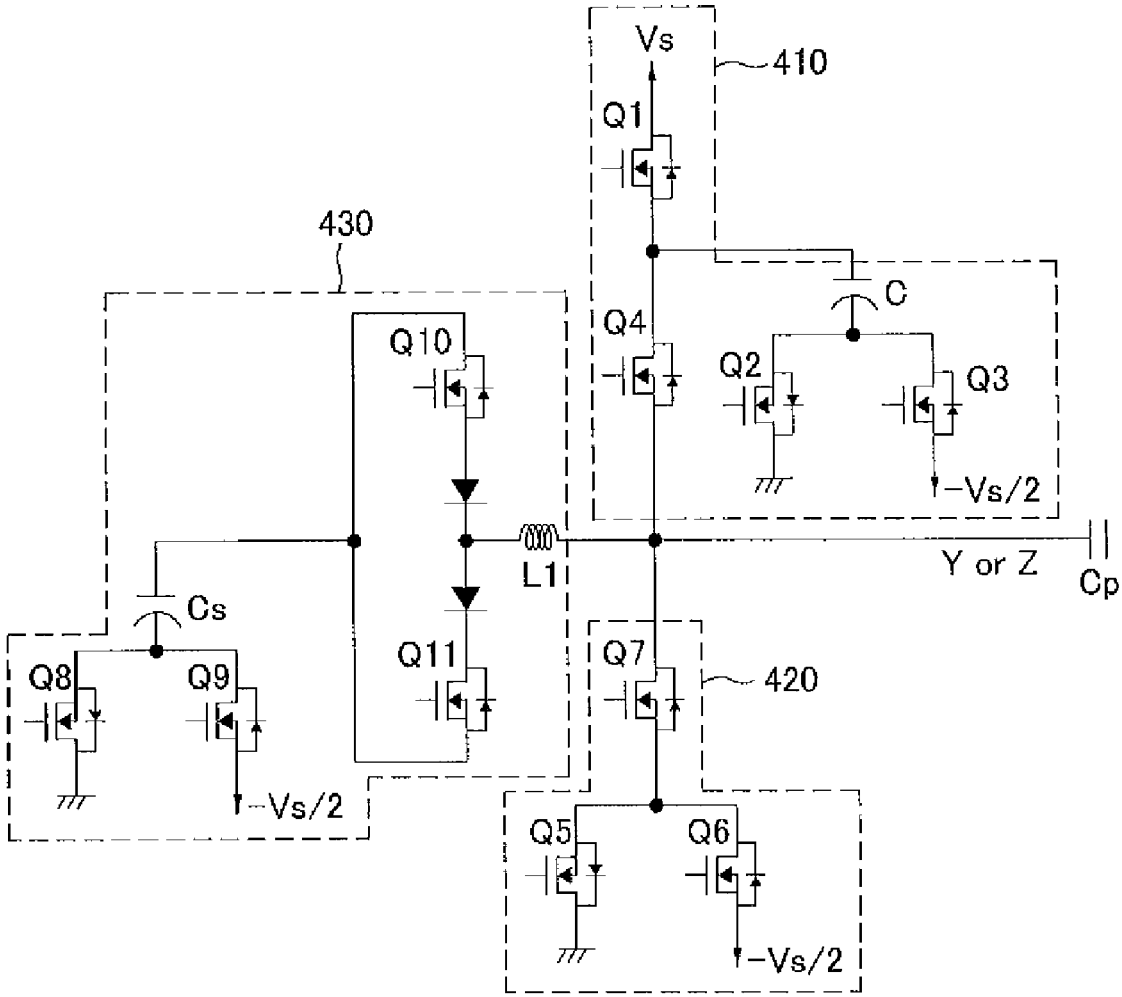
FIG. 4A illustrates the scan driver or the sustain driver of FIG. 1.

As illustrated in FIG. 4A, the scan driver or the sustain driver of FIG. 1 comprises a first voltage supplier 410, a second voltage supplier 420, a signal forming unit 430, and an energy storage unit 440.

The first voltage supplier 410 comprises a first switch Q1 for supplying the highest voltage of the first and second sustain signals, a second switch Q2 and a third switch Q3 for supplying the highest voltage of the third and fourth sustain signals, and a fourth switch Q4 turned on when the highest voltage of the first to fourth sustain signals is supplied.

The second voltage supplier 420 comprises a fifth switch Q5 for supplying the highest voltage of the first sustain signal and the second sustain signal, a sixth switch Q6 for supplying the lowest voltage of the third sustain signal and the fourth sustain signal, and a seventh switch Q7 turned on when the lowest voltage of the first to fourth sustain signals is supplied.

The signal forming unit 430 supplies or recovers energy through resonance to form the first to fourth sustain signals.

The energy storage unit 440 comprises a capacitor Cs for storing energy and the seventh switch Q7 and an eighth switch Q8 for supplying the reference voltage of the capacitor Cs.

Figure 4B:
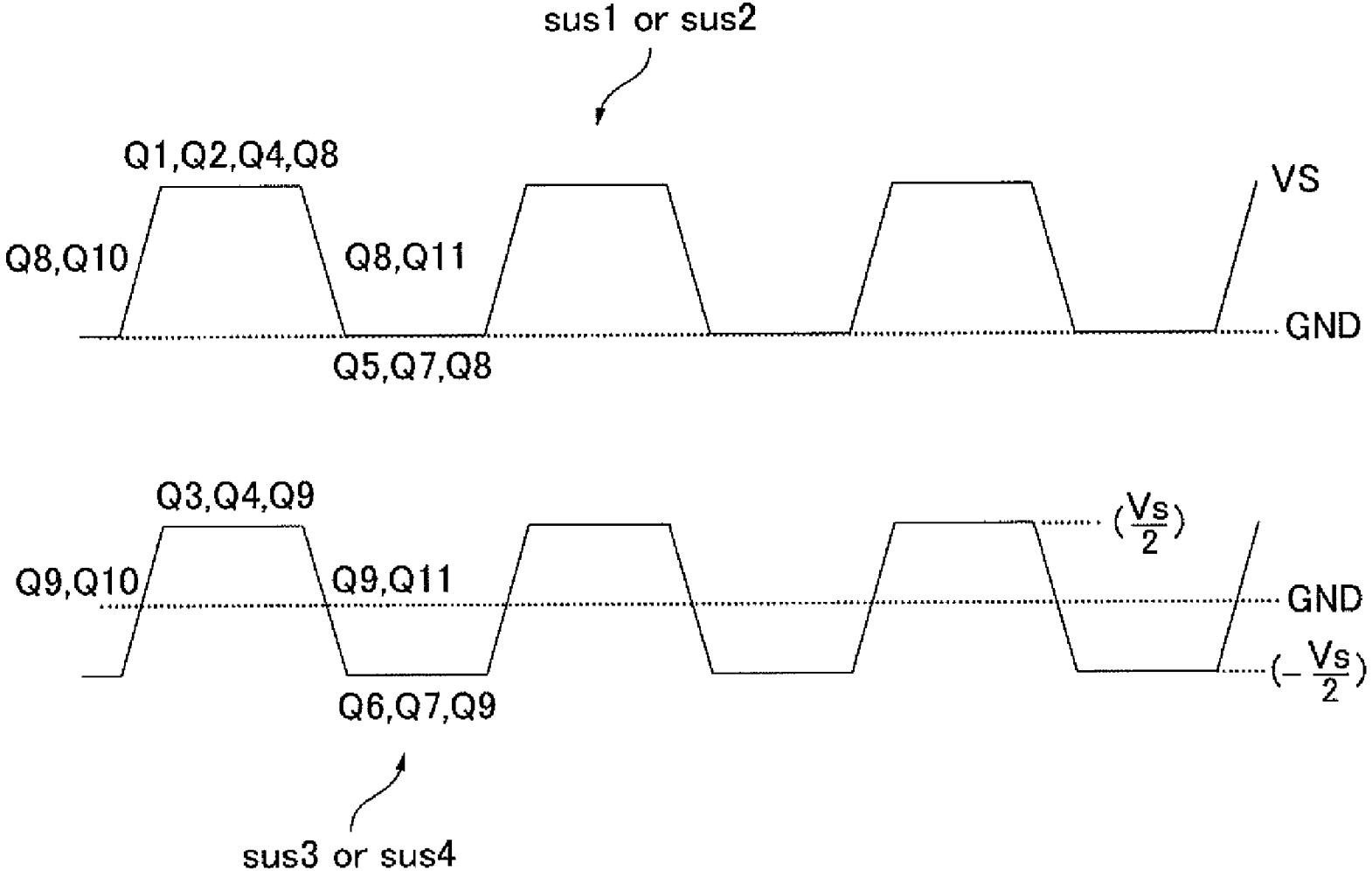
FIG. 4B illustrates the operation of the scan driver or the sustain driver of FIG. 4A.

As illustrated in FIG. 4B, the eighth switch Q8 of the energy storage unit 440 and the $10^{th}$ switch Q10 of the signal forming unit 430 are turned on and the remaining switches are turned off. Therefore, resonance is formed between an inductor L and the PDP so that the voltage of the scan electrodes Y or the sustain electrodes Z gradually increases from the ground voltage to the sustain voltage Vs.

The first switch Q1, the second switch Q2, the fourth switch Q4, and the eighth switch Q8 are turned on and the remaining switches are turned off. Therefore, the voltage of the scan electrodes Y or the sustain electrodes Z is sustained as the sustain voltage Vs and the capacitor C of the first voltage supplier 410 is filled with the sustain voltage Vs. In particular, the seventh Q7 is turned off and the body diode of the seventh switch Q7 intercepts the sustain voltage Vs supplied to the scan electrodes Y or the sustain electrodes Z.

The eighth switch Q8 and the $11^{th}$ switch Q11 are turned on and the remaining switches are turned off. Therefore, resonance is formed between the inductor L and the PDP so that the voltage of the scan electrodes Y or the sustain electrodes Z is gradually reduced from the sustain voltage Vs to the ground voltage.

The fifth switch Q5, the seventh switch Q7, and the eighth switch Q8 are turned on and the remaining switches are turned off. Therefore, the voltage of the scan electrodes Y or the sustain electrodes Z is sustained as the ground voltage GND. The first sustain signal sus1 or the second sustain signal sus2 is formed through the above-described processes.

As illustrated in FIG. 4B, the ninth switch Q9 of the energy storage unit 440 and the $10^{th}$ switch Q10 of the signal forming unit 430 are turned on and the remaining switches are turned off. Therefore, resonance is formed between the inductor L and the PDP so that the voltage of the scan electrodes Y or the sustain electrodes Z gradually increases from −Vs/2 to Vs/2.

The third switch Q3, the fourth switch Q4, and the ninth switch Q9 are turned on and the remaining switches are turned off. Therefore, since −Vs/2 is supplied to the capacitor C of the first voltage supplier 410 and the sustain voltage Vs is filled in the capacitor C, the voltage of the scan electrodes Y or the sustain electrodes Z is sustained as Vs/2. In particular, the seventh switch Q7 is turned off and the body diode of the seventh switch Q7 intercepts the Vs/2 supplied to the scan electrodes Y or the sustain electrodes Z.

The ninth switch Q9 and the $11^{th}$ switch Q11 are turned on and the remaining switches are turned off. Therefore, resonance is formed between the inductor L and the PDP so that the voltage of the scan electrodes Y or the sustain electrodes Z is gradually reduced from Vs/2 to −Vs/2.

The sixth switch Q6, the seventh switch Q7, and the ninth switch Q9 are turned on and the remaining switches are turned off. Therefore, the voltage of the scan electrodes Y or the sustain electrodes Z is sustained as −Vs/2. The third sustain signal sus3 or the fourth sustain signal sus4 are formed through the above-described processes.

Figure 5:
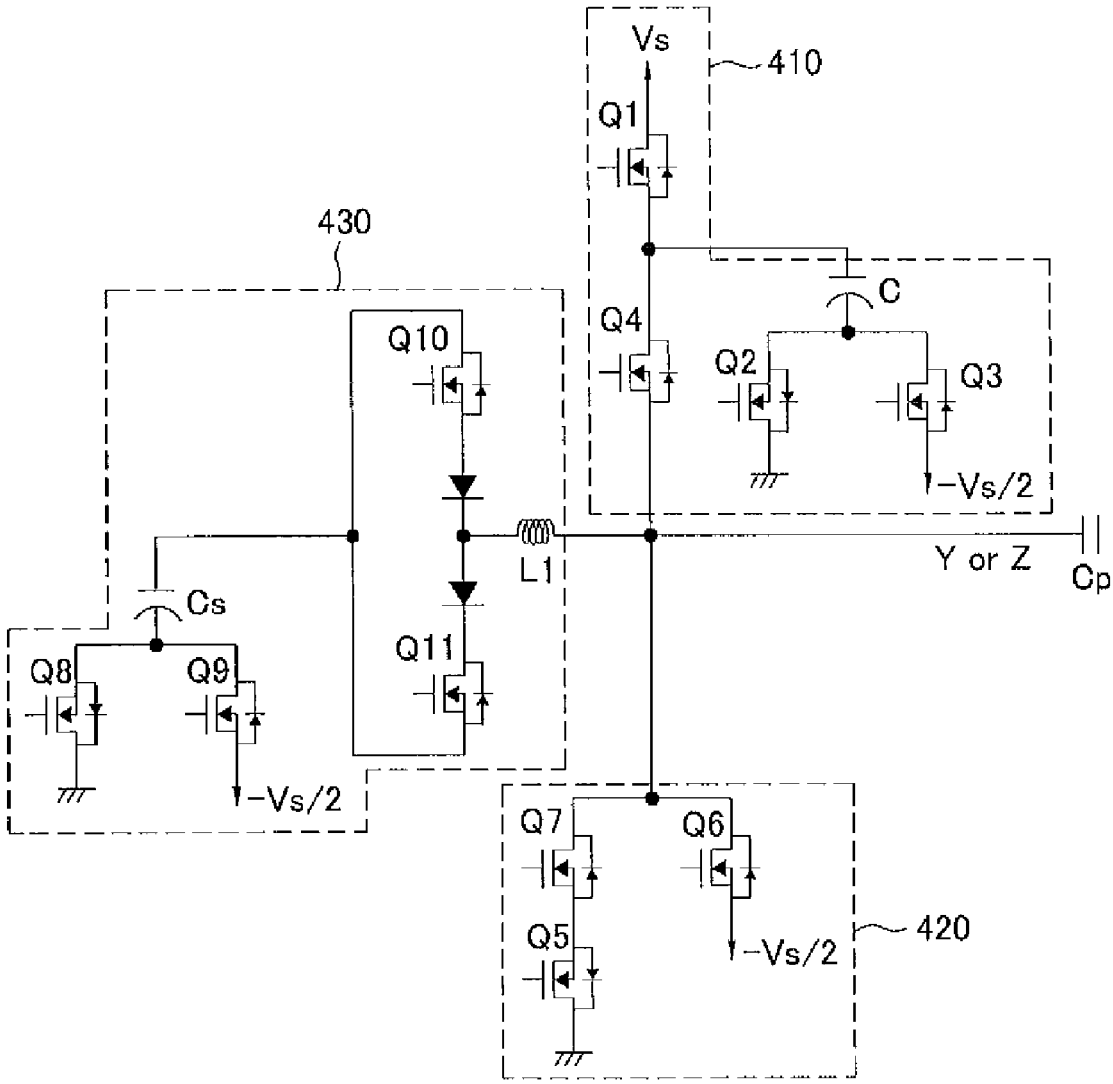
FIG. 5 describes a driver for driving sustain electrodes in a plasma display apparatus according to the present invention.

As illustrated in FIG. 5, the fifth switch Q5 and the seventh switch Q7 can be common-source connected to each other.

The foregoing embodiments and advantages are merely exemplary and are not to be construed as limiting the present invention. The present teaching can be readily applied to other types of apparatuses. The description of the foregoing embodiments is intended to be illustrative, and not to limit the scope of the claims. Many alternatives, modifications, and variations will be apparent to those skilled in the art.

What is claimed is:

1. A plasma display apparatus, comprising:

a plasma display panel comprising a first electrode and a second electrode; and a driver alternately supplying a first sustain signal and a second sustain signal to the first electrode and the second electrode in a first subfield and supplying a third sustain signal and a fourth sustain signal that swing a positive polar voltage and a negative polar voltage in a second subfield to the first electrode and the second electrode.

2. The plasma display apparatus of claim 1, wherein, a voltage difference between the first electrode and the second electrode while a highest voltage of the first sustain signal or the second sustain signal is supplied is actually equal to a voltage difference between the first electrode and the second electrode while a highest voltage of the third sustain signal or the fourth sustain signal is supplied.

3. The plasma display apparatus of claim 1, wherein a difference between the highest voltage of the first sustain signal and the highest voltage of the third sustain signal is no less than ⅕ of the highest voltage of the first sustain signal or the highest voltage of the third sustain signal.

4. The plasma display apparatus of claim 1, wherein the highest voltage of the third sustain signal is ½ of the highest voltage of the first sustain signal.

5. The plasma display apparatus of claim 1, wherein the number of light-emission times in a sustain period of the first subfield is smaller than the number of light-emission times in a sustain period of the second subfield.

6. The plasma display apparatus of claim 1, wherein the first subfield and the second subfield are comprised in one frame.

7. The plasma display apparatus of claim 1, wherein the first subfield and the second subfield are comprised in different frames, and when a temperature of the plasma display panel in the first subfield is higher than a temperature of the plasma display panel in the second subfield, the driver supplies the first and second sustain signals in the first subfield period and the third and fourth sustain signals in the second subfield period.

8. The plasma display apparatus of claim 1, wherein the driver supplies the first sustain signal and the second sustain signal in the first subfield comprised in the first frame and supply the third sustain signal and the fourth sustain signal in the second subfield comprised in the second frame when an average picture level (APL) of the first frame is higher than an APL of the second frame.

9. The plasma display apparatus of claim 1, wherein the driver supplies the first sustain signal and the second sustain signal when m frames are displayed on the plasma display panel per a second and supplies the third sustain signal and the fourth sustain signal when n (n>m) frames are displayed on the plasma display panel per a second.

10. The plasma display apparatus of claim 1, wherein the driver supplies the first sustain signal and the second sustain signal when a moving image is displayed on the plasma display panel and supplies the third sustain signal and the fourth sustain signal when a still image is displayed on the plasma display panel.

11. The plasma display apparatus of claim 1, wherein the driver comprises:

a first voltage supplier comprising a first switch for supplying the highest voltage of the first and second sustain signals, a second switch and a third switch for supplying the highest voltage of the third and fourth sustain signals, and a fourth switch turned on when the highest voltage of the first to fourth sustain signals is supplied;

a second voltage supplier comprising a fifth switch for supplying a lowest voltage of the first and second sustain signals, a sixth switch for supplying a lowest voltage of the third and fourth sustain signals, and a seventh switch turned on when a lowest voltage of the first to fourth sustain signals is supplied;

a signal forming unit for supplying or recovering energy through resonance to form the first to fourth sustain signals; and an energy storage unit comprising a capacitor for storing energy and the seventh switch and an eighth switch for supplying a reference voltage of the capacitor.

12. A method of driving a plasma display apparatus comprising a first electrode and a second electrode, the method comprising:

alternately supplying a first sustain signal and a second sustain signal to the first electrode and the second electrode in a first subfield; and supplying a third sustain signal and a fourth sustain signal that swing a positive polar voltage and a negative polar voltage to the first electrode and the second electrode in a second subfield.

13. The method of claim 12, wherein, a voltage difference between the first electrode and the second electrode while a highest voltage of the first sustain signal or the second sustain signal is supplied is actually equal to a voltage difference between the first electrode and the second electrode while a highest voltage of the third sustain signal or the fourth sustain signal is supplied.

14. The method of claim 12, wherein a difference between the highest voltage of the first sustain signal and the highest voltage of the third sustain signal is no less than ⅕ of the highest voltage of the first sustain signal or the highest voltage of the third sustain signal.

15. The method of claim 12, wherein the highest voltage of the third sustain signal is ½ of the highest voltage of the first sustain signal.

16. The method of claim 12, wherein the number of light-emission times in a sustain period of the first subfield is smaller than the number of light-emission times in a sustain period of the second subfield.

17. The method of claim 12, wherein the first subfield and the second subfield are comprised in different frames, and wherein, when a temperature of the plasma display panel in the first subfield is higher than a temperature of the plasma display panel in the second subfield, the first and second sustain signals are supplied in the first subfield period and the third and fourth sustain signals are supplied in the second subfield period.

18. The method of claim 12, wherein the first sustain signal and the second sustain signal are supplied in the first subfield comprised in the first frame and the third sustain signal and the fourth sustain signal are supplied in the second subfield comprised in the second frame when an average picture level (APL) of the first frame is higher than an APL of the second frame.

19. The method of claim 12, wherein the first sustain signal and the second sustain signal are supplied when m frames are displayed on the plasma display panel per a second and the third sustain signal and the fourth sustain signal are supplied when n (n>m) frames are displayed on the plasma display panel per a second.

20. The method of claim 12, wherein the first sustain signal and the second sustain signal are supplied when a moving image is displayed on the plasma display panel and supply the third sustain signal and the fourth sustain signal are supplied when a still image is displayed on the plasma display panel.

* * * * *